US009498050B2

(12) United States Patent
Boucherie

(10) Patent No.: US 9,498,050 B2
(45) Date of Patent: Nov. 22, 2016

(54) PAINT BRUSH

(75) Inventor: Bart Gerard Boucherie, Izegem (BE)

(73) Assignee: GB Boucherie NV, Izegem (BE)

( * ) Notice: Subject to any disclaimer, the term of this patent is extended or adjusted under 35 U.S.C. 154(b) by 455 days.

(21) Appl. No.: 12/937,296

(22) PCT Filed: Jan. 26, 2009

(86) PCT No.: PCT/EP2009/000475
§ 371 (c)(1),
(2), (4) Date: Oct. 11, 2010

(87) PCT Pub. No.: WO2009/127280
PCT Pub. Date: Oct. 22, 2009

(65) Prior Publication Data

US 2011/0023249 A1 Feb. 3, 2011

(30) Foreign Application Priority Data

Apr. 16, 2008 (DE) ..... 10 2008 019 111

(51) Int. Cl.

| | |
|---|---|
| ***A46D 3/00*** | (2006.01) |
| ***A46B 5/00*** | (2006.01) |
| ***A46B 3/02*** | (2006.01) |
| ***A46B 3/06*** | (2006.01) |
| ***A46B 3/12*** | (2006.01) |
| ***A46B 7/00*** | (2006.01) |
| *A46B 7/04* | (2006.01) |
| *A46B 3/00* | (2006.01) |

(52) U.S. Cl.
CPC . *A46B 5/00* (2013.01); *A46B 3/02* (2013.01); *A46B 3/06* (2013.01); *A46B 3/12* (2013.01); *A46B 7/00* (2013.01); *A46B 3/005* (2013.01); *A46B 7/04* (2013.01); *A46B 2200/202* (2013.01)

(58) Field of Classification Search
CPC ..... A46B 3/005; A46B 7/04; A46B 5/00; A46B 3/02; A46B 3/00
USPC ..... 15/191.1, 192, 193; 300/21
See application file for complete search history.

(56) References Cited

U.S. PATENT DOCUMENTS

| | | | | |
|---|---|---|---|---|
| 1,482,415 | A * | 2/1924 | Seaboyer et al. | 300/21 |
| 1,586,785 | A * | 6/1926 | Curtis | 15/398 |
| 1,603,626 | A * | 10/1926 | Molony | 15/191.1 |
| 1,687,079 | A * | 10/1928 | Barker | 15/110 |
| 2,258,361 | A * | 10/1941 | Hewes | 15/192 |
| 2,840,841 | A * | 7/1958 | Maxwell | 15/193 |
| 2,854,684 | A | 10/1958 | Hardman et al. | |
| 3,076,989 | A * | 2/1963 | Daw | 15/192 |

(Continued)

FOREIGN PATENT DOCUMENTS

| | | |
|---|---|---|
| CA | 2137368 | 11/1993 |
| CA | 2111262 | 6/1995 |

(Continued)

OTHER PUBLICATIONS

International Search Report.
International Preliminary Report on Patentability dated Dec. 13, 2010.

*Primary Examiner* — Michael Jennings
(74) *Attorney, Agent, or Firm* — Carlson, Gaskey & Olds, PC

(57) ABSTRACT

A paint brush has a handle, a bristle carrier plate fixed directly to the handle, and a plurality of bundles of bristles inserted into the bristle carrier plate through receiving openings.

36 Claims, 7 Drawing Sheets

(56) References Cited

U.S. PATENT DOCUMENTS

| | | | | | |
|---|---|---|---|---|---|
| 3,130,434 | A * | 4/1964 | Daw | 15/192 | |
| 3,133,299 | A * | 5/1964 | Danley et al. | 15/193 | |
| 3,153,801 | A * | 10/1964 | Hunt et al. | 15/193 | |
| 3,155,998 | A * | 11/1964 | Hardman et al. | 15/192 | |
| 3,172,141 | A * | 3/1965 | Arena | 15/192 | |
| 3,177,038 | A * | 4/1965 | Paccione | 300/21 | |
| 3,192,549 | A * | 7/1965 | Hunt et al. | 15/192 | |
| 3,214,778 | A * | 11/1965 | Mathison | 15/244.1 | |
| 4,575,894 | A * | 3/1986 | Stevens | A46B 5/0058 | 15/172 |
| 4,916,773 | A * | 4/1990 | McCoy | 15/205.2 | |
| 5,150,494 | A * | 9/1992 | Wenzer | 15/159.1 | |
| 5,289,606 | A * | 3/1994 | Ledingham | 15/168 | |
| 5,435,037 | A * | 7/1995 | Ledingham | 15/168 | |
| 5,483,723 | A * | 1/1996 | Wenzer | 15/193 | |
| 5,605,383 | A * | 2/1997 | Biocca | 300/21 | |
| 5,622,411 | A * | 4/1997 | Weihrauch | 300/21 | |
| 5,636,904 | A * | 6/1997 | Bell et al. | 300/21 | |
| 5,678,276 | A * | 10/1997 | Ledingham et al. | 15/168 | |
| 6,045,649 | A * | 4/2000 | Weihrauch | 156/272.8 | |
| 6,290,303 | B1 * | 9/2001 | Boucherie | 300/5 | |
| 6,406,099 | B2 * | 6/2002 | Boucherie | 300/21 | |
| 7,716,775 | B2 * | 5/2010 | DiPietro et al. | 15/159.1 | |
| 7,913,348 | B2 * | 3/2011 | Cox et al. | 15/204 | |
| 8,091,172 | B2 * | 1/2012 | Cox et al. | 15/204 | |
| 2001/0013152 | A1 * | 8/2001 | Meyer et al. | 15/193 | |
| 2002/0092108 | A1 * | 7/2002 | Fang | 15/192 | |
| 2003/0005533 | A1 * | 1/2003 | Woodnorth et al. | 15/143.1 | |
| 2003/0159224 | A1 * | 8/2003 | Fischer et al. | 15/110 | |
| 2003/0163884 | A1 * | 9/2003 | Weihrauch | 15/207.2 | |
| 2003/0182750 | A1 * | 10/2003 | Nishida et al. | 15/193 | |
| 2005/0283930 | A1 * | 12/2005 | Hooper et al. | 15/104.061 | |
| 2006/0150355 | A1 * | 7/2006 | Mason et al. | 15/166 | |
| 2008/0066253 | A1 | 3/2008 | Stevens | | |
| 2008/0313836 | A1 * | 12/2008 | Hobbs | 15/193 | |

FOREIGN PATENT DOCUMENTS

| | | | |
|---|---|---|---|
| CA | 2111262 | A1 | 6/1995 |
| CA | 2134368 | A1 | 4/1996 |
| CA | 2327493 | | 4/1999 |
| DE | 3425440 | A1 | 2/1986 |
| DE | 3425440 | | 7/1986 |
| DE | 19818553 | C1 * | 8/1999 |
| EP | 0573081 | | 12/1993 |
| EP | 0573081 | A1 | 12/1993 |
| EP | 1894489 | | 3/2008 |
| EP | 1894489 | A2 | 3/2008 |
| GB | 2132476 | | 7/1994 |
| WO | 8802998 | | 5/1988 |
| WO | 8802998 | A1 | 5/1988 |

* cited by examiner

PAINT BRUSH

RELATED APPLICATION

This application is the U.S. national phase of PCT/EP2009/000475, filed Jan. 26, 2009, which claims priority to German application 10 2008 019 111.6, filed Apr. 16, 2008.

TECHNICAL FIELD

The invention relates to a paint brush.

BACKGROUND

The most difficult problem in manufacturing paint brushes is the fastening of the bristles. On the one hand, it is necessary that a sufficiently large number of bristles can be fixed to obtain the desired density of the bundles of bristles formed from the bristles. On the other hand, it must be ensured that the bristles are reliably fixed so that they do not fall out when used.

One kind of fastening consists in inserting the bristles into a sleeve as a compact bundle and to glue the ends of the bristles arranged in the sleeve together, for example by using a synthetic resin. The handle of the paint brush is then connected with the sleeve. Though a very compact bundle of bristles can be obtained with this kind of fastening, the individual bristles are not held in a particularly reliable manner. Another kind of fastening consists in attaching the bristles in holes, for example in a wooden body, using small clamps. Though it is in principle possible that the bristles are comparatively well fixed with this kind of fastening, the holes used to receive the bristles must have a comparatively large distance from each other as otherwise, the body containing the holes does not have a sufficient stability to hold the clamps. The required distance of the holes from each other leads to the fact that the bundle of bristles is not particularly compact. This problem is even more serious if natural bristles are used, for example bristles of hog hair. For example, whereas in synthetic bristles the clamp can be arranged in the center of the bristles curved in a U-shaped and both ends of the bristle can be used, only one end can be used in the case of bristles of hog hair, more specifically the end opposite to the root of the hair. As a result, the bristles must be configured to be longer than the actual bundle of bristles, as the end portion placed inside the paint brush is bent to be adapted to be fixed with the clamp. This is disadvantageous with regard to cost, as natural bristles are particularly expensive. Furthermore, a very low compactness of the bundle of bristles is obtained.

A paint brush should have low manufacturing costs, a compact bundle of bristles, and a reliable fastening of the individual bristles.

SUMMARY

A paint brush is provided that has a handle, a bristle carrier plate fixed directly to the handle, and a plurality of bundles of bristles inserted into the bristle carrier plate through receiving openings. This configuration leads to several advantages. On the one hand, the entire pack of bristles is subdivided into a plurality of smaller bundles of bristles, which simplifies the fastening of the bristles. On the other hand, as the bundles of bristles are inserted through the receiving openings, the use of clamps is unnecessary, for which reason the receiving openings can be configured so as to be comparatively large. This leads to a compact pack of bristles.

It is preferably provided that the bristle carrier plate is a grid. A grid distinguishes itself in that the proportion of the receiving openings is very large in comparison with the total surface area and in particular larger than 50 percent. In this way, a particularly high density of the pack of bristles is obtained.

According to an embodiment, the handle is provided with a mounting into which the bristle carrier plate is inserted. This leads to a particularly stable connection between the bristle carrier plate and the handle and moreover to an appealing appearance. Furthermore, the mounting can be configured so deep that the edges of the mounting support the pack of bristles.

According to an alternative embodiment, it is provided that on a side facing the handle, the bristle carrier plate is provided with a surrounding collar. This permits an insertion of the handle into the collar, the latter being thus adapted to be connected with the bristle carrier plate in a mechanically stable manner and with little effort. The handle can be glued to the bristle carrier plate or can be mechanically attached thereto, for example using nails, a snap connection, a screw connection, a welding connection, etc. A further advantage of the surrounding collar consists is that a clear limitation of the area is provided in which the bundles of bristles are connected with the bristle carrier plate and the handle is also connected with the bristle carrier plate.

Alternatively, the handle can also be injection-molded with the bristle carrier plate, either within the collar or also so as to engage around the bristle carrier plate from the outside.

According to an embodiment, it is provided that the bristle carrier plate is surrounded by a sleeve which also realizes a connection with a shaft. The sleeve takes the function of the collar. The advantage of this embodiment consists in that the bristle carrier plate can be reached more easily for the insertion of the bundles of bristles. The sleeve can be made of sheet metal so that the paint brush is optically very similar to a conventional paint brush.

It is preferably provided that on a side facing the bristles, the bristle carrier plate is provided with a surrounding collar. The collar supports the pack of bristles so that the bristles are securely held together. The collar can have parallel walls or walls that extend towards each other, away from the bristle carrier plate.

Depending on the intended use, the bristle carrier plate can be even or also arched. This is advantageous particularly with regard to stiffness.

The compactness of the pack of bristles can also be influenced by the way of arranging the bundles of bristles in the bristle carrier plate. For example, at least one of the bundles of bristles can be arranged in a direction which is not perpendicular to the bristle carrier plate. Exterior rows of the bundles of bristles can, for example, be inclined towards the center of the pack of bristles. A higher density of the bristles in those regions in which it is advantageous can thus be obtained, or an improved capillarity of the bristles can be achieved.

The compactness of the pack of bristles can also be varied in that the surface proportions of the receiving openings differ from each other in different parts of the bristle carrier plate. Due to the use of smaller receiving openings in the outer region, for example, which are surrounded by appropriately wider webs, a compactness can be obtained in the outer region of a pack of bristles that is lower than in the center, where larger receiving openings can be used for example, that are surrounded by thinner webs. In this way, it is also possible to form small empty spaces in appropriate places at the basis of the pack of bristles, that means near the bristle carrier plate, these empty spaces serving as "storeroom" for paint. By an appropriate arrangement and dimensioning of these storerooms, the quantity of paint and the uniformity of the paint reaching the bristle tips during painting is influenced.

The bristles of a bundle of bristles are preferably connected with each other at their ends inserted through the receiving openings. This ensures that no bristles are detached from a bundle of bristles.

The ends of the bristles of a bundle of bristles that are inserted through the receiving openings can be welded together, for example. This is particularly advantageous if the bristles are made of a plastic material. The ends of the bristles can be pressed against a heated fusion die, for example, so that they melt and are welded together. Simultaneously, if desired, the corresponding side of the bristle carrier plate can also be melted by an appropriate configuration of the fusion die and an appropriate selection of the pressure, so that the ends of the bundles of bristles are also welded to the bristle carrier plate. If necessary, after the melting of the bristles, a new pressing action into the melted bristles can be performed using a second die in order to process the surface or to obtain a better density.

Alternatively, it can be provided that the bristles of a bundle of bristles are glued together at their ends inserted through the receiving openings, for example using a synthetic resin. This is particularly advantageous if the bristles are made of a material which is not suitable for welding. Due to the adhesive, the bundles of bristles can also immediately be connected with the bristle carrier plate.

In order to optimally adapt the paint brush to the respective intended use, it can be provided that the bristle carrier plate is fitted with different bristles. One example of such a fitting consists in fitting the receiving openings arranged on the outer surface of the bristle carrier plate with particularly wear-resistant bristles, and to fit the receiving openings arranged in the center of the bristle carrier plate with particularly paint absorbent bristles.

It is also possible to arrange different bristles in a receiving opening, for example a combination of synthetic bristles and natural bristles.

BRIEF DESCRIPTION OF THE DRAWINGS

The invention will be described below with reference to different embodiments which are illustrated in the accompanying drawings and in which.

DETAILED DESCRIPTION

Figure 1:
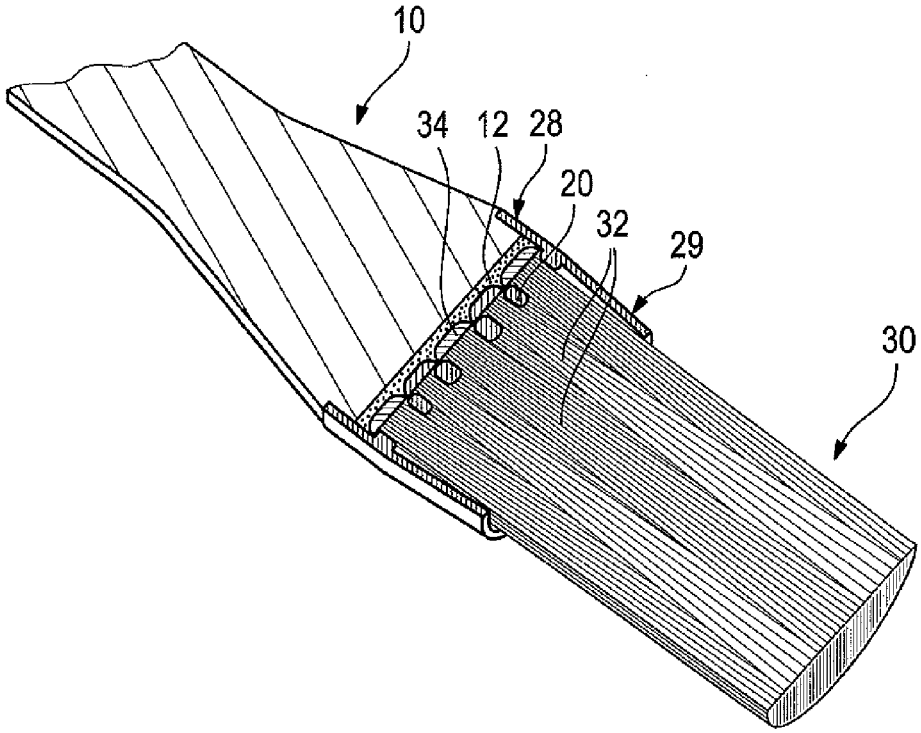
FIG. 1 shows in a schematic, broken section a paint brush according to a first embodiment of the invention.
Figure 2:
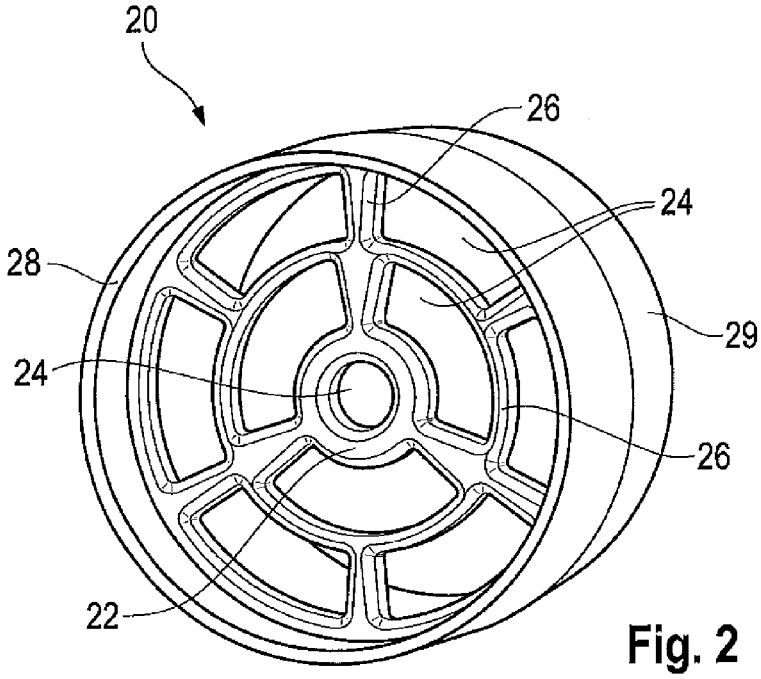
FIG. 2 shows in a perspective view a bristle carrier plate used in the paint brush of FIG. 1.

FIGS. 1 and 2 show a paint brush according to a first embodiment. The essential parts of this paint brush are a handle 10, a bristle carrier plate 20 and a pack 30 of bristles.

The bristle carrier plate 20 (see FIG. 2) has a grid-like body 22 in which a plurality of receiving openings 24 is formed, which are separated from each other by webs 26. The receiving openings 24 serve to receive bundles 32 of bristles of which the pack 30 of bristles is composed. The shape of the receiving openings 24 is substantially determined by the desired properties of the paint brush and by solidity requirements. The larger the surface proportion of the receiving openings 24 is in comparison with the total surface area of the body 22, the higher the density of the pack 30 of bristles is. However, the solidity of the bristle carrier plate 20 also decreases as the webs 26 must be configured appropriately thinner. The shape of the receiving openings 24 substantially depends on how the bristles and the bundles 32 of bristles formed by the receiving openings 24 are to be arranged within the pack 30 of bristles.

Both sides of the webs 26 around the receiving openings 24 can be provided with chamfers to facilitate the insertion of the bundles 32 of bristles into the receiving openings 24, on the one hand, and, on the other hand, to improve the connection of the ends of the bristles inserted through the bristle carrier plate 20 with the bristle carrier plate. Furthermore, empty spaces which act as a storeroom for paint are produced by the webs at the basis of the pack of bristles. By an appropriate arrangement and dimensioning of these empty spaces, it is determined how much paint can be made available there, how many bristles are in contact with the paint and how fast and uniformly the paint is guided from there to tips of the bristles during painting.

The outer surface of the grid-like body 22 is provided with a collar 28 (see also FIG. 1) which serves to receive the handle 10. A second collar 29 is provided on the other side of the grid-like body 22, which surrounds the pack 30 of bristles and serves to support the bristles. Here, the collar 29 is configured such that its walls converge away from the bristle carrier plate. In this way, the bristles are held together and supported particularly well.

The bundles 32 of bristles are inserted through the receiving openings 24 via the ends that are to be anchored in the paint brush. The ends inserted through the grid-like body 22 are then connected with each other. In the first embodiment, the ends of the bristles have been welded together for this purpose, so that the mushroom-shaped welding heads 34 shown in FIG. 1 are formed. Alternatively, the ends of the bristles can be melted in a common, continuous film-like plastic compound. The film-like plastic compound can be uniformly thick or have different thicknesses over its surface. A thickened portion of the film-like compound, for example, can be formed where the bundles of bristles are located. At the same time, the ends of the bundles 32 of bristles can be welded to the bristle carrier plate 20, more specifically to the webs 26 surrounding the receiving openings 24. To this end, the bristle carrier plate 20 is preferably made of a plastic material which can be welded to the material of the bristles.

The handle 10 is inserted into the collar 28 and is connected to collar 28 using a layer of adhesive 12. A synthetic resin, for example, can be used as adhesive. The collar 28 has the advantage of precisely receiving the handle 10 to provide a mechanically stable fastening. The collar 28 also ensures that no adhesive 12 and no other material of the ends of the bundles 32 of bristles that are welded together can escape to the outside. An optically very clear connection between the handle 10 and the bristle carrier plate 20 is therefore ensured.

Instead of being connected by the adhesive 12, the handle 10 can also be connected with the bristle carrier plate 20 in a different manner, for example, by a latching or a clip connection, by nails, screws, or a thread, etc. It is also possible to manufacture the handle 10 of a plastic material, for example, with the handle being directly injection-molded into the bristle carrier plate 20 to fasten the handle 10 and bristle carrier plate 20 together.

Figure 3:
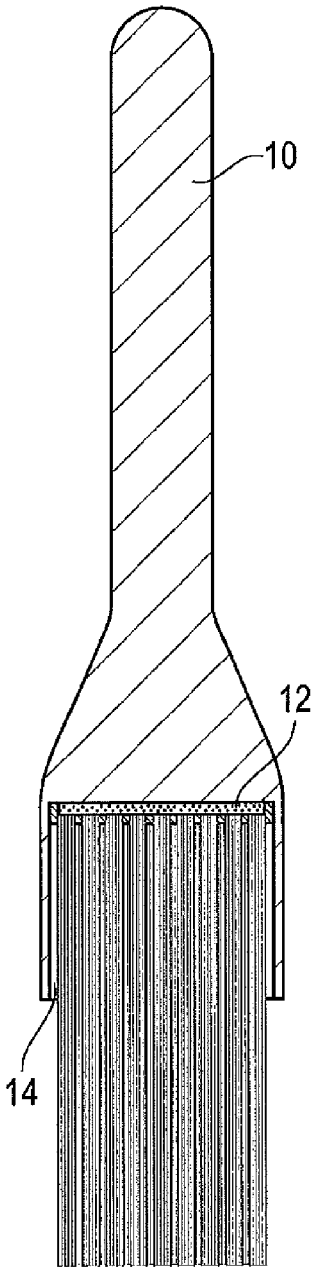
FIG. 3 shows a paint brush according to a second embodiment in a sectional view.
Figure 4:
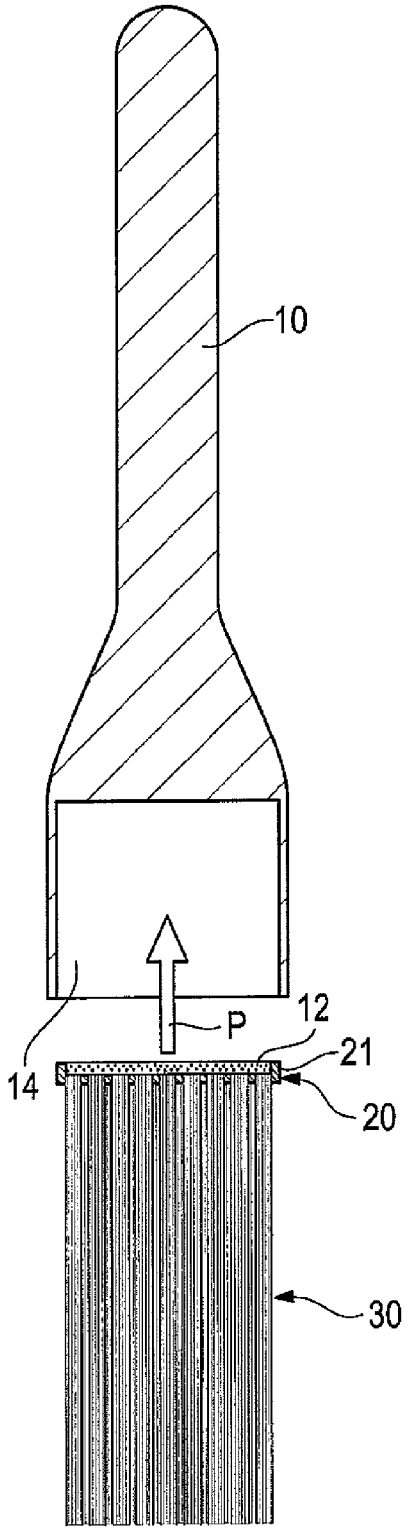
FIG. 4 shows an exploded view of the paint brush of FIG. 3.

FIGS. 3 and 4 show a paint brush according to a second embodiment. The same reference numerals are used for the components known from the first embodiment, and in this respect, reference is made to the above explanations.

Generally speaking, the difference between the first and the second embodiment consists in that in the second embodiment, it is not the handle which is inserted into the bristle carrier plate, but the bristle carrier plate 20 which is inserted into the handle 10. To this end, the handle is provided with a mounting 14 which is configured like a large blind hole. The bristle carrier plate 20 fitted with the bristles is inserted into the mounting 14 (see the case P in FIG. 4). The mounting 14 is configured to be deep within the handle 10 such that a free edge of a skirt forming the mounting 14 surrounds and supports the pack 30 of bristles in a manner similar to the collar 29 of the first embodiment.

In the second embodiment, the bristle carrier plate 20 is configured without any collar. Only a small collar 21 is provided on the side on which the ends of the bristles are connected with the bristle carrier plate 20, this collar preventing an adhesive 12 used to fasten the bundles 32 of bristles from flowing downwards along the side of the bristle carrier plate 20. The collar 21 further provides for a higher mechanical stability of the bristle carrier plate 20.

To fasten the bristle carrier plate 20 fitted with the bristles within the mounting 14, it is possible to use an adhesive 12, as shown in FIG. 3, or to use any other kind of fastening.

A further difference to the first embodiment consists in that the collar surrounding the bristles is configured with parallel walls. This permits to manufacture the collar with little effort in a injection-molding process.

Figure 5:
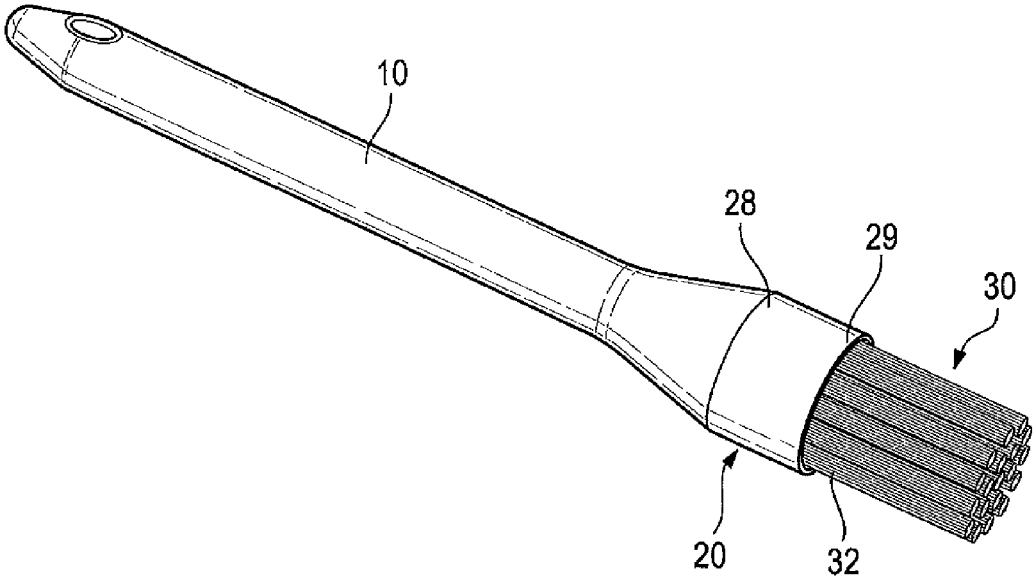
FIG. 5 shows a paint brush according to a third embodiment in a perspective view.
Figure 6:
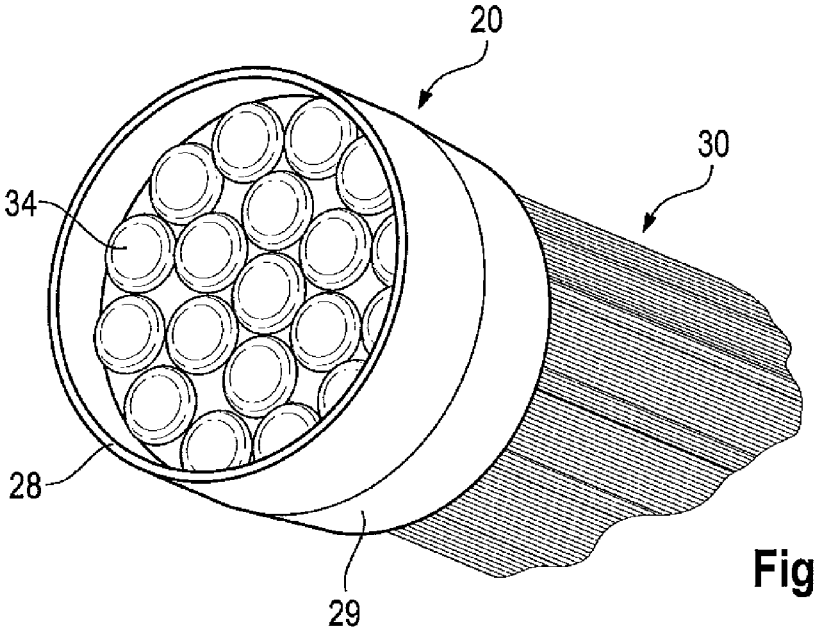
FIG. 6 shows in a perspective view the bristle carrier plate used in the paint brush of FIG. 5, with bundles of bristles inserted.
Figure 7:
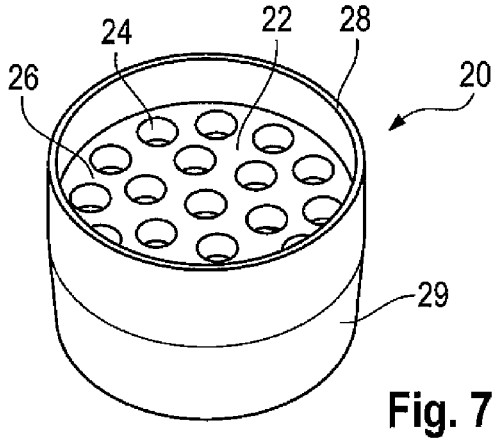
FIG. 7 shows in a perspective view the bristle carrier plate used in the paint brush of FIG. 5.

FIGS. 5 to 7 show a third embodiment. The same reference numerals are used for the components known from the previous embodiments, and in this respect, reference is made to the above explanations.

The essential difference between the first and the third embodiment consists in that in the third embodiment, the surface proportion of the receiving openings 24 for the bundles 32 of bristles is smaller than in the first embodiment. This leads to a lower compactness of the pack 30 of bristles. Furthermore, it can be seen that the surface proportion of the receiving openings 24 in an exterior annular region of the grid-like body 22 is larger than in the center.

Figure 8:
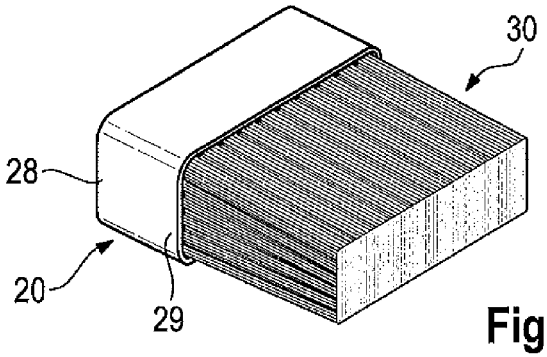
FIG. 8 shows in a perspective view a bristle carrier plate with bundles of bristles inserted for a paint brush according to a fourth embodiment.
Figure 9:
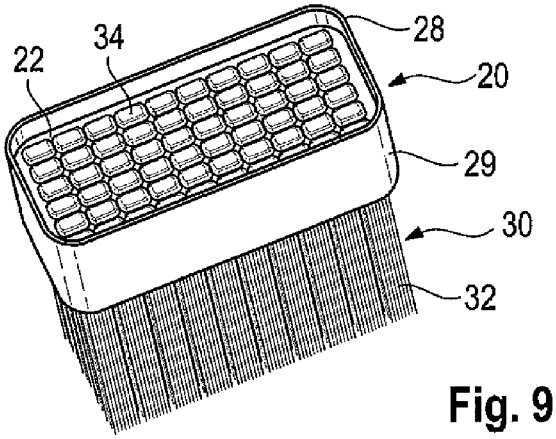
FIG. 9 shows the bristle carrier plate of FIG. 8 with bundles of bristles inserted in a further perspective view.

FIGS. 8 and 9 show a pack 30 of bristles with a bristle carrier plate 20 for a paint brush according to a fourth embodiment. The same reference numerals are used for the components known from the previous embodiments, and in this respect, reference is made to the above explanations.

Figure 10A:
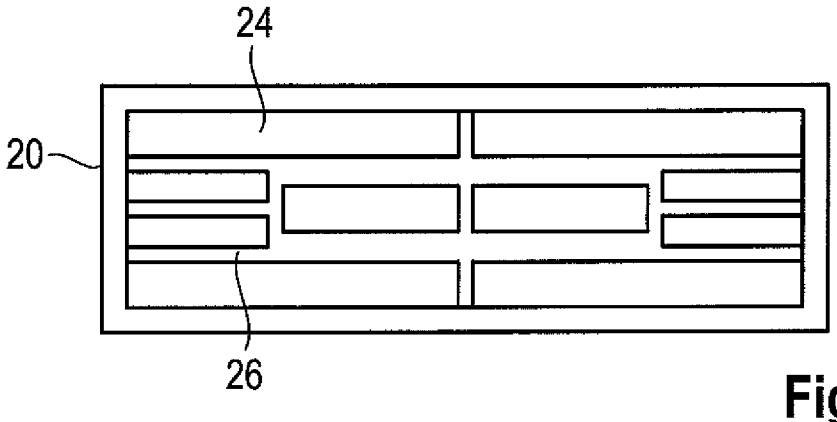
FIGS. 10*a*, 10*b*, and 10*c* show three variants of a bristle carrier plate which can be used in the paint brush according to the fourth embodiment.
Figure 10B:
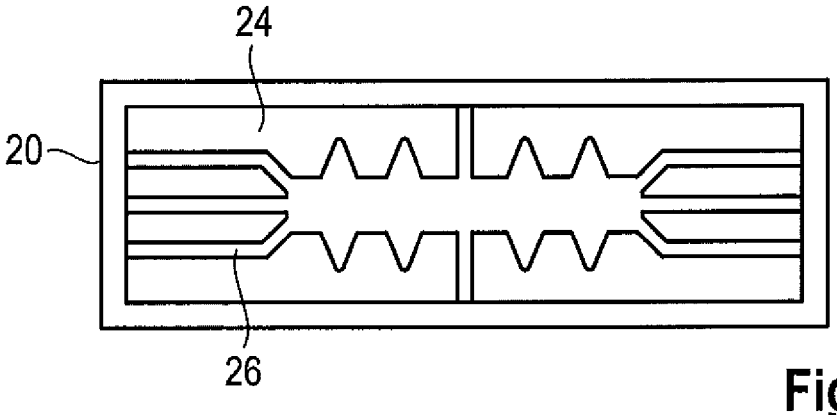
Figure 10C:
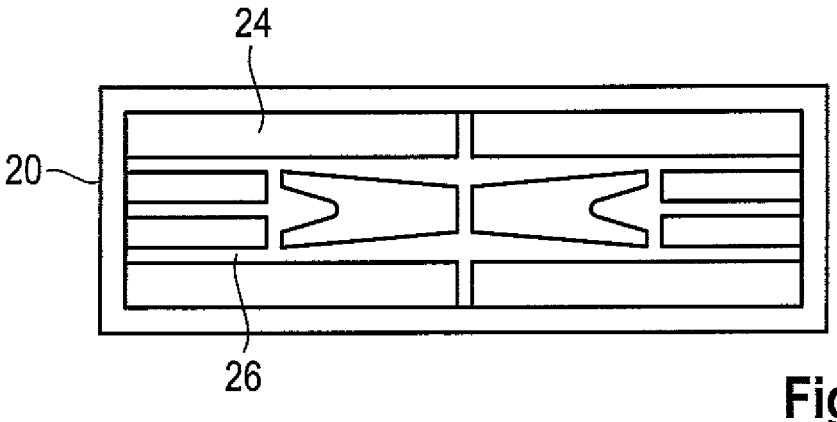

FIGS. 10*a*, 10*b*, and 10*c* show different variants of the bristle carrier plate 20 which differ from each other in that the receiving openings 24 have different configurations, and in that different webs 26 are between the receiving openings 24. In addition to the different densities of the pack 30 of bristles of the respective paint brush resulting therefrom, storerooms for paint are formed by the webs 26 at the basis of the pack 30 of bristles. In the variant of FIG. 10*a*, an approximately annular rectangular storeroom is formed, whereas in the variant of FIG. 10*b*, a center storeroom is formed which is provided with eight "oriels". In the variant of FIG. 10*c*, a generally rectangularly surrounding storeroom is formed, similar to FIG. 10*a*, the cross-section of which however increases towards the center The essential difference between the first and the fourth embodiment consists in that in the fourth embodiment, the bristle carrier plate 20 is rectangular. Rectangular receiving openings are also used for the bundles 32 of bristles, as can be seen in FIG. 9 with respect to the shape and the arrangement of the welded ends of the bundles of bristles.

Figure 11:
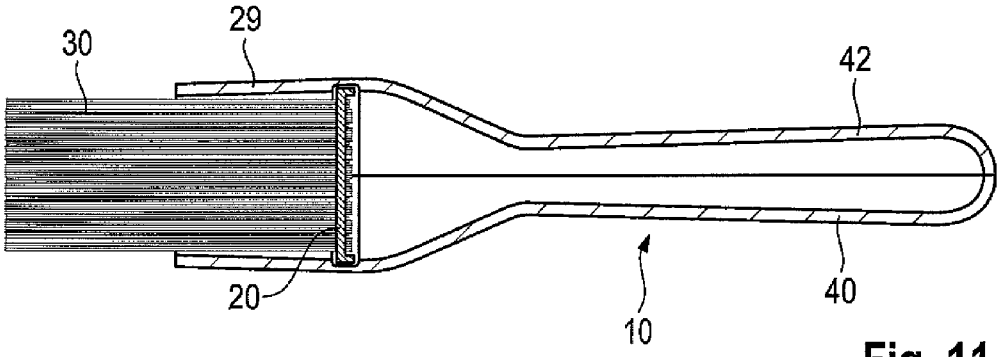
FIG. 11 shows a paint brush according to a fifth embodiment in a schematic sectional view.

FIG. 11 shows a paint brush according to a fifth embodiment. The same reference numerals are used for the components known from the previous embodiments, and in this respect, reference is made to the above explanations.

Figure 12:
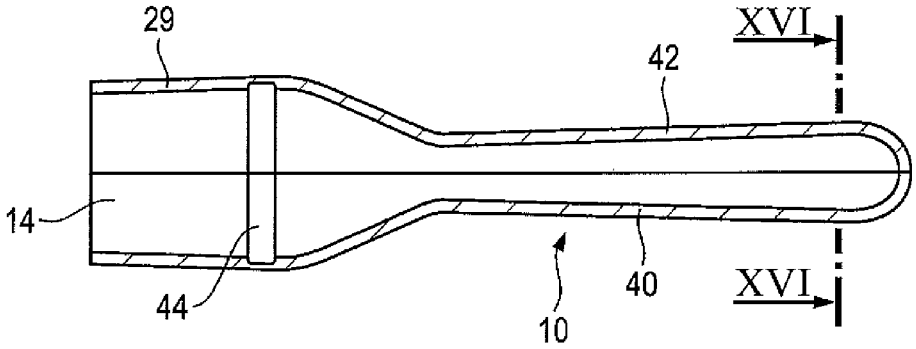
FIG. 12 shows the handle of the paint brush of FIG. 11 in a schematic sectional view.

The essential difference to the first embodiment, for example, consists in that in the fifth embodiment, the handle 10 is configured so as to be hollow and is composed of two shells 40, 42. The collar 29 is formed in one piece with the handle 10, the collar 29 supporting and holding the pack 30 of bristles together. To this end, the collar 29 tapers to the front. The bristle carrier plate 20 is received in the handle by engaging a surrounding groove 44 (see FIG. 12) which is formed in both shells 40, 42.

The bristle carrier plate 20 can easily be held in a mechanical way in the groove 44. Alternatively, the bristle carrier plate 20 can be bonded or welded therein.

The hollow handle according to the fifth embodiment leads to a paint brush having a very low weight. Furthermore, the two shells 40, 42 can very easily be manufactured in an injection mold as each shell can easily be removed from the mold, with the mold parting plane extending in a center through the handle. In this configuration, the collar 29 can moreover be configured in a tapering manner without any difficulties.

Figure 13:
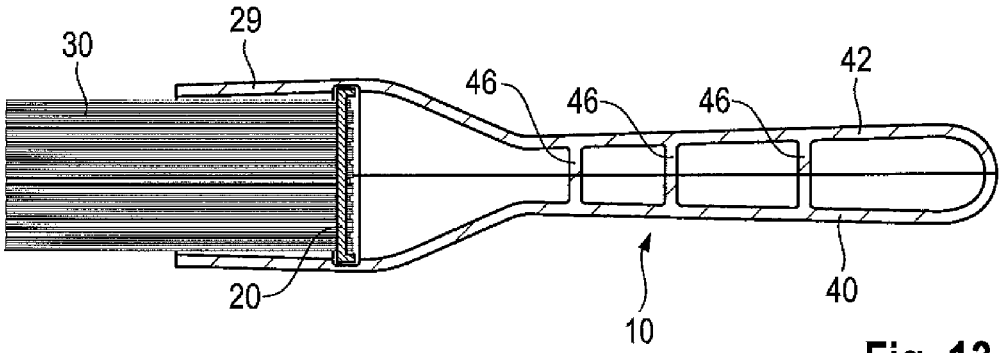
FIG. 13 shows a first variant of the paint brush according to the fifth embodiment.

FIG. 13 shows a first variant of the fifth embodiment. The difference to the paint brush shown in FIG. 11 is that the handle is reinforced inside by three ribs 46 so that it cannot be pressed together, even if a low wall thickness is used.

Figure 14:
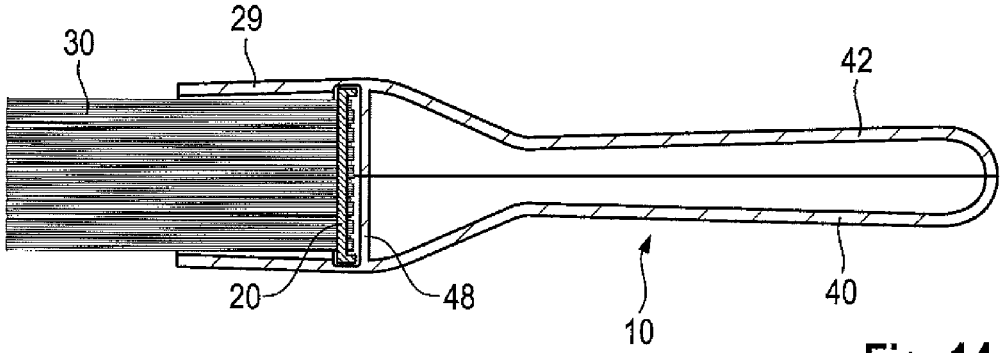
FIG. 14 shows a second variant of the paint brush according to the fifth embodiment.

FIG. 14 shows a second variant of the fifth embodiment. The difference to the paint brush shown in FIG. 11 is that a closure plate 48 is arranged in the transition region between the collar 29 and the handle 10. This plate 48 serves as a support for the bristle carrier plate 20 and prevents the bristle carrier plate 20 from being pressed into the handle 10 due to an excessively high pressure applied to the pack 30 of bristles. The closure plate 48 also serves as a separation between the region of the pack 30 of bristles and the handle 10 and prevents paint from flowing into the inside of the hollow handle 10.

Figure 15:
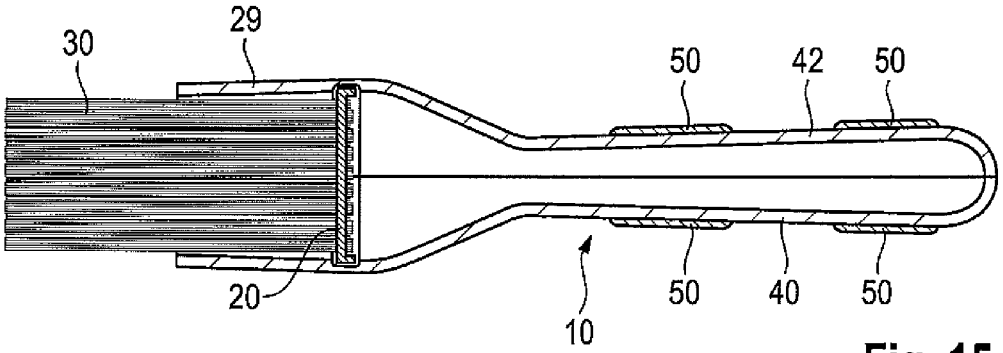
FIG. 15 shows a third variant of the paint brush according to the fifth embodiment.

FIG. 15 shows a third embodiment of the fifth embodiment. The difference to the paint brush shown in FIG. 11 is that the two shells 40, 42 are configured as a multicomponent part. In the example shown, two parts 50 made of a plastic material that is softer than the material of the two shells 40, 42, for example of a thermoplastic elastomer, are applied on the two shells 40, 42 by injection-molding in the region of the handle. Such a softer plastic material improves the handling feeling and can be arranged in an appropriate manner depending on the requirements, for example, as a support for a thumb and/or index finger of the user.

According to a further variant that is not illustrated, it can be provided that the collar 29 is injection-molded from a flexible material with the two shells 40, 42 which form the handle 10. In this way, a flexible support within certain limits is obtained for the pack 30 of bristles. It is also possible to inject only part of the collar from the flexible material, whereas other parts are made of the same harder material as the handle 10

For the sake of completeness, reference is made to the fact that the features of FIGS. 13 to 15 can be combined with each other in any way.

Figure 16:
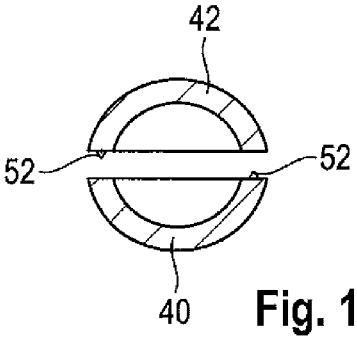
FIG. 16 shows a schematic section through the handle of the paint brush according to the fifth embodiment.

FIG. 16 shows the two shells 40, 42 in a sectional view. In the embodiment shown, it can be seen that on a longitudinal edge, each shell 40, 42 is provided with a small surrounding welding edge 52, an even edge of the other shell being opposite thereto. This permits a connection of the two shells with each other by ultrasonic welding. It is particularly advantageous that the two shells 40, 42 are configured identically so that one and the same injection mold can be used to manufacture the two shells 40, 42. Alternatively, only one of the two shells 40, 42 could be provided with the welding edge 52.

It is also possible to connect the two shells 40, 42 in any other by way than by welding. The two shells 40, 42 can be glued or mechanically clipped together, or can be connected with each other by injection-molding (for example by injecting a second material component therearound).

In all embodiments, different materials can be used for the bristles. It is in particular possible to use bristles of plastic material and of natural fibers such as hog hair, cattle hair, badger etc. In the case of plastic bristles, solid bristles or hollow bristles can be used. The cross-sectional shape of the bristles can be adapted to the respective requirements, they can be round, star-shaped, triangular, rectangular, for example, or can have a combination of different cross-sectional shapes. Different bristle materials can also be combined within one receiving opening, for example bristles of plastic with natural bristles. The tips of the bristles can be pre-manufactured and can be rounded or bevelled, for example.

Unlike the embodiments shown, the thickness of the grid-shaped body can be varied so that a higher thickness is provided in mechanically more stressed regions, for example.

A particular advantage resulting from the use of the bristle carrier plate 20 having receiving openings 24 is that the shape of the pack 30 of bristles can be manufactured with little effort in the desired manner by simply inserting the bristles to a greater or lesser extent into the receiving openings 24. It is also possible to use bristles having different lengths from the start so that the cuttings are minimized, which leads to low manufacturing costs.

The bristle carrier plate can be provided with elements such as fingers, lamellas, etc. which can be made of a flexible material such as a thermoplastic elastomer, for example. These elements can support the bristles within the pack of bristles. With such elements, it is also possible to produce specific painting effects, structural effects, etc. for example. The bristle carrier plate can also be provided with elements such as sponges, etc. between the packs of bristles, which form a paint stock and influence the paint absorption or the paint distribution.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A paint brash comprising:

a handle defining an axis extending from a first end to an opposite second end; a bristle carrier plate fixed directly to the handle at one of the first and second ends; and a plurality of bundles of bristles inserted into the bristle carrier plate through receiving openings such that the bristles extend substantially parallel to the axis from a first end to a free end, and wherein the bristles of each bundle of bristles are connected to the bristle carrier plate the first at ends of the bristles that are inserted through an associated one of the receiving openings, and wherein the first ends of the bristles of each bundle are connected to each other;

a collar held fixed relative to the handle to surround the bundles of bristles and wherein the collar extends from the bristle carrier plate towards the free ends of the bristles; and wherein the bristle carrier plate comprises a grid-like body that includes the receiving openings, and wherein the collar comprises a first collar extending from one end of the grid-like body and including a second collar extending from an opposite end of the grid-like body, the second collar being fixed to the handle and the first collar surrounding the bristles.

2. The paint brush according to claim 1, wherein the bristle carrier plate is a grid.

3. The paint brush according to claim 1, wherein the collar comprises a first collar extending from one side of the bristle carrier plate towards the free ends of the bristle, and wherein on an opposite side of the bristle carrier plate which faces the handle, the bristle carrier plate is provided with a second collar that surrounds the first ends of the bristles and is fixed to the handle.

4. The paint brush according to claim 3, wherein the handle is inserted into the second collar.

5. The paint brush according to claim 1, wherein the handle is glued to the bristle carrier plate.

6. The paint brush according to claim 1, wherein the collar is fixedly connected with the handle such that the collar does not move relative to the handle.

7. The paint brush according to claim 6, wherein the collar is formed in one piece with the bristle carrier plate.

8. The paint brush according to claim 6, wherein the collar converges towards the free ends of the bundle of bristles such that distal tips of the free ends extend axially beyond the collar.

9. The paint brush according to claim 1, wherein the bristle carrier plate is even.

10. The paint brush according to claim 1, wherein at least one of the bundles of bristles has a longitudinal axis which is not perpendicular to the bristle carrier plate.

11. The paint brush according to claim 1, wherein surface proportions of the receiving openings differ from each other in different parts of the bristle carrier plate.

12. The paint brush according to claim 1, wherein receiving spaces for paint are formed at a basis of the bundles of bristles between the bundles of bristles.

13. The paint brush according to claim 1, wherein bristles of each bundle of bristles are welded together at the first ends inserted through the receiving openings and wherein the free ends of the bristles extend axially beyond the collar.

14. The paint brush according to claim 1, wherein bristles of each bundle of bristles are glued together at the first ends inserted through the receiving openings.

15. The paint brush according to claim 1, wherein the bristle carrier plate is fitted with bristles that are different from each other.

16. The paint brush according to claim 1, wherein the receiving openings arranged on an outer surface of the bristle carrier plate are fitted with wear-resistant bristles, and wherein receiving openings arranged in a center of the bristle carrier plate are fitted with paint absorbent bristles.

17. The paint brush according to claim 1, wherein an inclination of the bundles of bristles is selected to provide a desired paint absorption.

18. The paint brush according to claim 1, wherein an inclination of the bundles of bristles is selected to obtain a desired painting effect.

19. The paint brush according to claim 1, wherein at least part of ends of the bundles of bristles are inclined towards each other.

20. The paint brush according to claim 1, wherein at least part of ends of the bundles of bristles are inclined towards a center of the paint brush.

21. The paint brush according to claim 1, wherein different bristles are arranged within one receiving opening.

22. The paint brush according to claim 1, wherein the bristle carrier plate is surrounded by a sleeve that also provides a fixed connection with the handle.

23. The paint brush according to claim 1, wherein the handle comprises a solid body.

24. The paint brush according to claim 1, wherein the bristle carrier plate comprises a grid body having the receiving openings separated from each other by webs.

25. The paint brush according to claim 24, wherein the receiving openings are circumferentially spaced apart from each other about a center of the grid body.

26. The paint brush according to claim 1, wherein the plurality of bundles of bristles are welded to the bristle carrier plate.

27. The paint brush according to claim 1, wherein the plurality of rundles of bristles are glued to the bristle carrier plate.

28. The paint brush according to claim 1, wherein the plurality of bundles of bristles include both bristles of plastic and bristles of natural material.

29. The paint brush according to claim 1, wherein the bristle carrier plate is comprised of a plastic material.

30. The paint brush according to claim 1, wherein the bristle carrier plate is attached to the handle with adhesive.

31. The paint brush according to claim 1, wherein the bristle carrier plate is permanently fixed to the handle and to the collar.

32. The paint brash according to claim 1, wherein the bristles are configured to hold paint and wherein the free ends of the bristles extend axially beyond the first collar.

33. The paint bush according to claim 1, wherein empty areas are formed between bundles of bristles to comprise a storage area for paint.

34. The paint bush according to claim 1, wherein the bristle carrier plate includes webs that separate the receiving openings from each other, and wherein the webs facilitate the formation of paint storage areas near the first end of the bristles such that paint can be guided along the bristles to the free ends which extend outwardly of the collar.

35. The paint brush according to claim 1, wherein the bristle carrier plate is mounted to the first end of the handle and wherein the second end comprises a hand grip.

36. The paint bush according to claim 1, wherein the handle is defined by a width and a length that is greater than the width, and wherein the axis extends along the length of the handle from the first end to the second end.

* * * * *